United States Patent [19]

Holle

[11] 4,174,492

[45] Nov. 13, 1979

[54] DEVICE FOR ATTENUATING CAVITY INTERFERENCE WAVES IN A HIGH-FREQUENCY ELECTRON TUBE

[75] Inventor: Johannes Holle, Berlin, Fed. Rep. of Germany

[73] Assignee: Siemens Aktiengesellschaft, Berlin & Munich, Fed. Rep. of Germany

[21] Appl. No.: 814,350

[22] Filed: Jul. 11, 1977

[30] Foreign Application Priority Data

Jul. 19, 1976 [DE] Fed. Rep. of Germany ..... 2632404

[51] Int. Cl.[2] ..... H01J 7/46; H01J 19/80

[52] U.S. Cl. ..... 315/39; 333/228; 333/251; 331/97

[58] Field of Search ..... 315/39, 3.5; 333/83 A, 333/98 M; 331/97, 98

[56] References Cited

U.S. PATENT DOCUMENTS

| | | | |
|---|---|---|---|
| 2,644,889 | 7/1953 | Finke et al. | 315/39 X |
| 3,360,679 | 12/1967 | Rubert | 315/3.5 |
| 3,365,607 | 1/1968 | Ruetz et al. | 315/3.5 |
| 3,412,279 | 11/1968 | Allen et al. | 315/3.5 |
| 3,634,790 | 1/1972 | Turteltaub | 333/83 A |
| 3,995,241 | 11/1976 | Mourier | 315/39 |

*Primary Examiner*—Saxfield Chatmon, Jr.
*Attorney, Agent, or Firm*—Hill, Van Santen, Steadman, Chiara & Simpson

[57] ABSTRACT

A device for attenuating electromagnetic cavity interference waves, which occur in the vacuum system of a high-frequency electron tube, in particular a transmitting tube, comprising a wave-guide portion coupled to the cavity of the electron tube, which may or may not form a part of the vacuum system of the electron tube, and which wave-guide portion may have a length corresponding approximately to a quarter wave length of the interference waves, and is provided with a high-ohmic resistive coating, the high resistance of which is transformed by the wave-guide portion into a low resistance with respect to the cavity interference waves which are to be attenuated, in the cavity of the electron tube.

7 Claims, 4 Drawing Figures

DEVICE FOR ATTENUATING CAVITY INTERFERENCE WAVES IN A HIGH-FREQUENCY ELECTRON TUBE

BACKGROUND OF THE INVENTION

The invention relates to a device for attenuating electromagnetic cavity interference waves which occur in the vaccum system of a high-frequency electron tube, in particular a transmitter tube.

In high-gain high-frequency electron tubes, cavity resonances result in disturbing cavity waves in the cavity of the electron tube, i.e. so-called interference modes. Transmitter tubes, constructed with coaxially disposed cylindrical electrodes, which are connected to a cavity resonator forming an anode circuit, with the electrodes combined into a single component operating with high operating conductance, are particularly subject to this type of interference. In such type of tube the electromagnetically active, coaxial length of grid and anode is equal to one quarter of the useful wave length, with the corresponding $\lambda/4$-tuning being effected by means of a coaxial shorting ring disposed between the grid and anode.

FIG. 1 of the drawing schematically illustrates, in axial cross section, such a prior art tube employing cylindrically shaped electrodes, in which the reference numeral 1 designates the cathode, which is surrounded by a grid indicated generally by the reference numeral 2, with the cathode-grid assembly being disposed within a hollow cylindical anode structure 3, provided with a shorting ring 4 disposed between the grid 2 and the anode 3. The diameter of the grid is designated by the reference letter "d", and the diameter of the anode 3, in the electrically active region of the grid 2, is designated by the reference letter "D". The length of the coaxial portion of grid 2 and anode 3, as defined by the shorting ring 4, is designated by the reference number l', While the axial distance between the terminal of the anode 3 and the grid 2 is designated by "Δ", with $l'+\Delta=l$. The length l' is then approximately $\lambda/4$, i.e. one quarter of the wave length of the useful frequency, which, for example, maybe 470 MHz and 790 MHz, in European television bands IV/V.

In a coaxial construction with a grid diameter d and an anode diameter D, the critical wave length may be defined by the equation $$\lambda_g \approx \frac{\pi}{2}(d + D) \tag{1}$$

where the corresponding critical frequency is the lowest frequency of the waves which are propagated on the coaxial conductor formed by the grid 2 and the anode 3, and whih may be assumed to be of infinite length, namely the frequency of the $H_{11}$ wave.

The axially closed anode 3 and the shorting ring 4 between the grid 2 and anode 3 form a coaxial cavity resonator, in which standing waves can form, which are present as interference modes. In this case the lowest interference frequency is that of the $H_{11}$ wave, which forms as $H_{111}$ cavity resonance wave having a length l as half wave length. This resonance wave length $\lambda_{Res}$ possesses the following relationship with respect to the critical wave length $\lambda_g$ and the resonator length l:

$$\lambda_{Res} = \frac{\lambda_g}{\sqrt{1 + \left(\frac{\lambda_g}{2l}\right)^2}} \tag{2}$$

The two formulae (1) and (2) may be employed to calculate the frequency of the $H_{111}$-wave for given dimensions of the electron tube. Other resonances can also occur at higher frequencies. In the absence of special provisions, such resonances are substantially unattenuated, and in electron tubes having high conductance, such as required, particularly for high-frequence transmitter tubes, under suitable feed back conditions self-excitation can take place.

In order to prevent resonances of this type, German OS No. 25 26 127=U.S. Pat. No. 3,970,971 suggests the disposition of attenuating material at those points of the anode at which the interference mode currents flow. This is achieved by embedding ferrite rods into the anode which are disposed transversely to the currents involved. The interference mode currents which are to be attenuated are thereby compelled to flow in loops around the ferrite rods, and are thus magnetically attenuated. However, this method of attenuation, employing ferrite material, involves the disadvantage that such material has characteristics which are detrimental to the vacuum of the tube.

BRIEF SUMMARY OF THE INVENTION

The present invention is directed to a vacuum tube structure providing an interference mode attenuation which is not detrimental to the vacuum system of the tube.

In accordance with the invention it is proposed, in a tube of the type discussed, to provide a wave-guide portion which is coupled to the cavity of the electron tube, with such wave-guide portion being provided with a high-ohmic resistive coating, with such high resistance being transformed by the wave-guide portion into a low resistance, by means of which the cavity interference waves in the cavity of the electron tube are attenuated.

Although the above referred to prior art teaches that it is advantageous that no frequency selection is effected during the attenuation, this is applicable only to those interference modes whose currents flow at the same locations and in the same direction. Other interference modes are not involved and are not attenuated in the absence of ferrite rods disposed transversely to their current paths. Consequently, in this respect, the attenuation may, in fact, comprise a frequency selection. In the realization of the invention, a selection does occur since the transformation is carried out selectively. However, due to the fact that the transformation is carried out over a wide band, the most important interference modes can be covered by the attenuation.

A very important advantage resides in the fact that no attenuation is carried out in the actual tube, with the attenuating material being disposed elsewhere than on or in the anode and, in addition, a freer choice of attenuating material is permitted, with respect to the maintenance of the vacuum. In other words, there is no restriction to the use of ferrite material.

The invention also achieves a further device advantage in that the wave-guide portion may be coupled to the cavity without constituting a component of the vacuum vessel or system. This may be achieved by the employment of a dielectric window which permits a complete freedom of choice with respect to the attenuating materials. In other words, such attenuation materials need no longer be considered in connection with impairment of the vacuum.

In a further advantageous development, the wave-guide portion may be in the form of a sealed coaxial conductor portion, which is tuned, in particular, to a quarter of the wave length of the most important interference wave range, and which, with the capacitance present between the cavity of the electron tube and the wave-guide portion, forms a series oscillating circuit with the location of the attentuating material being such that it can be readily cooled. The respective features advantageously can be utilized either individually or in arbitrary combinations.

The present invention also contemplates novel advantageous designs in the construction of the dielectric window, by means of which, in effect a further resistance transformation can be achieved. For this purpose, the thickness of the window may be so designed that a $\lambda/2$-transformation is effected in the interference wave range, or in which the window is divided into a plurality of subordinate sections or windows. In this case a plurality of thin-walled window sections may be arranged in serially spaced arrangement, with the interspacing therebetween providing transformations which produce the desired low resistance effect in the cavity.

In a further advantageous embodiment of the window, the thickness of the latter may be approximately equal to one quarter wave length of the interference wave range, with the characteristic impedance in the window being the geometric mean of the characteristic impedances in the cavity of the electron tube and in the wave-guide portion.

BRIEF DESCRIPTION OF THE DRAWINGS

In the drawings wherein like reference characters indicate like or corresponding parts.

DETAILED DESCRIPTION OF THE INVENTION

Figure 1:
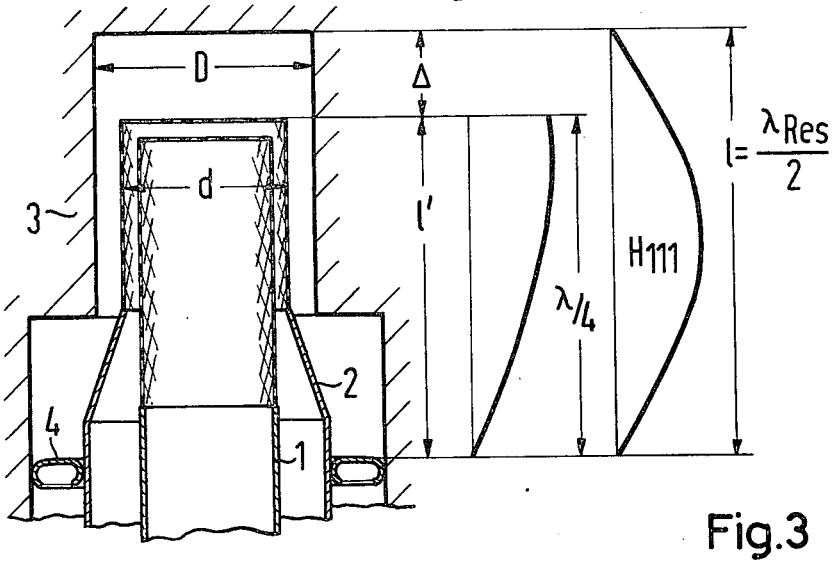
FIG. 1 is an axial sectional view of a prior art tube to which the present invention is applicable.
Figure 3:
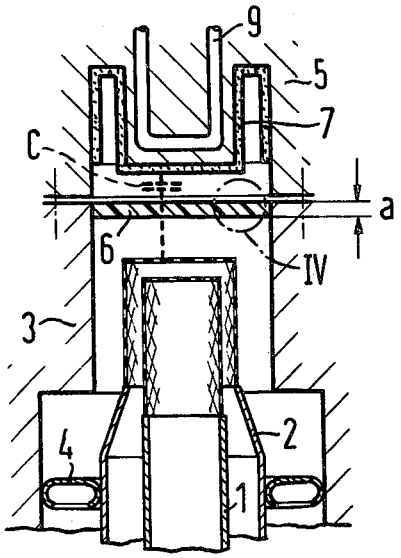
FIG. 3 is a similar sectional view illustrating a further embodiment of the invention, in which the wave-guide portion is coupled to the cavity of the electron tube over a dielectric window.
Figure 2:
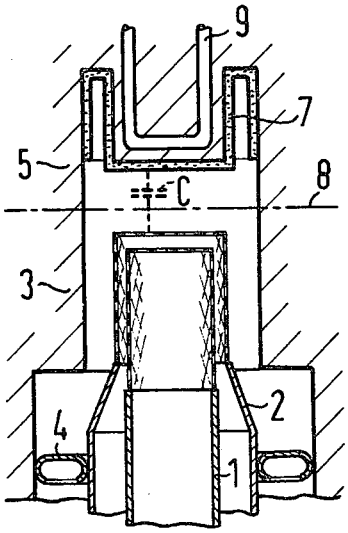
FIG. 2 is a similar sectional view illustrating the application of the present invention thereto, in which the wave-guide portion is constructed as a part of the vacuum system of the electron tube.

FIGS. 2 and 3 illustrate high frequency electron tubes utilizing cylindrical coaxial electrodes which may, for example, be employed as transmitter tubes, and it will be appreciated that the cathode, grid and anode structure correspond generally to that illustrated in FIG. 1 previously described. Corresponding parts thus employ like reference characters. However, the construction illustrated in FIG. 2 is additionally provided with a wave-guide resonator portion, indicated generally by the numeral 5, which is directly coupled to the anode 3 and thus is subjected to the vacuum in common with the anode structure. FIG. 3 illustrates a similar construction with the exception that the wave-guide portion 5 is detachable from the anode 3 and does not form a part of the vacuum system of the tube. In this case the electromagnetic coupling is effected over a dielectric window 6.

In both cases the coaxial conductor portion 5 forms a cavity resonator comprising an inner conductor and an outer conductor which, for matching purposes, advantageously has the same characteristic impedance as the coaxial arrangement of grid 2 and anode 3. As illustrated, in each case, a resistive coating 7 of attenuating material may be applied to the base of the cavity resonator and to the entire length of the inner conductor. The length of the cavity resonator is so designed that the high resistance of the attenuating material is, in effect, transformed over a $\lambda/4$-transformation or over an equivalent transformation employing odd-numbered multiples of $\lambda/4$, in dependence upon the structural requirements, into an apparent low resistance. Consequently, this structure forms the electrical termination for the actual cavity or vacuum cavity of the electron tube in which the disturbing resonance waves are formed. The attenuation influence of the resistive coating 7 thus can act upon the plane 8 which defines the resonance chamber. Heating of the resistive coating 7 occurring in operation can be readily dissipated by cooling, for example by means of a cooling tube 9 as illustrated in FIGS. 2 and 3.

The capacitance C which exists between the grid 2 and the inner conductor of the cavity resonator 5 is schematically illustrated in dotted lines in FIGS. 2 and 3. As a result of suitable dimensioning, an attenuation which is selective with respect to the specific interference modes can be achieved whereby the cavity resonator 5 forms a series oscillating circuit with the capacitance C.

In the embodiment illustrated in FIG. 3, the cavity resonator 5 is disposed exteriorly of the vacuum system of the tube. This is accomplished by disposing between the cavity resonator 5 and the anode 3 a dielectric window 6 which has a thickness a and is composed of a material having a dielectric constant $\epsilon_r$. If the $\lambda/4$ transformation is effected solely by the cavity resonator 5, the thickness a of the window 6 advantageously is such that a $\lambda/2$ transformation is effected for the interference wave range, i.e. there is no change in resistance. In such case the following equation is applicable:

$$a=(\lambda_{Res}/2\sqrt{\epsilon r}) \quad (3)$$

This non-transformation of the dielectric window 6, without disturbing reflections, can be achieved by the utilization of a window having thickness a equal to one quarter wave length of the interference wave range, and the characteristic impedance of the dielectric window 6 equal to the geometric mean of the characteristic impedance in the vacuum and that in the cavity resonator.

Figure 4:
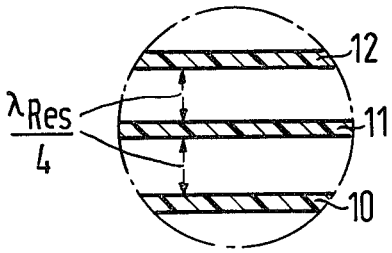
FIG. 4 is a transverse section through a modified window structure.

In a further embodiment, the dielectric window 6 may be constructed from a plurality of thin window sections 10, 11 and 12 which are axially disposed in series and spaced by a distance $\lambda Res/4$, as illustrated in FIG. 4, which corresponds to an enlargement of the portion IV of FIG. 3. In utilizing this construction, the selection of such window sections as to number, thickness and spacing between respective sections should be so selected that the effective resistance transformation corresponding to the invention is ensured.

The embodiment of the invention utilizing a dielectric window 6 has the particular advantage that the attenuation device of the invention, and the electron tube which is to be attenuated therewith, can be manufactured and operated without structural limitations and without regard to temperature limits, as well as vacuum deterioration of the attenuating material. As a result of the relatively free choice with respect to the location of the attenuating material, the provision of cooling facilities, etc., a substantial decoupling between interference modes and useful waves can be achieved in a relatively simple manner.

Having thus described my invention it will be obvious that although various minor modifications might be suggested by those versed in the art, it should be understood that I wish to embody within the scope of the patent granted hereon all such modifications as resonably, and properly come within the scope of my contribution to the art.

I claim as my invention:

1. In a device for attenuating electromagnetic cavity interference waves, which occur in the vacuum system of a high frequency electron tube having an internal coaxial cavity resonator formed, in part, by the tube anode, the combination of a wave-guide resonator portion, a dielectric window disposed between and coupling the wave-guide portion to the cavity resonator and separating the wave-guide portion from the vacuum system of the tube, said wave-guide portion having a high ohmic resistive coating therein, which thus is external of the vacuum system, said wave-guide portion and resistive material, in effect, presenting a low resistance to interference modes to be attenuated, for the suppression thereof.

2. A device according to claim 1, wherein cooling means is provided adjacent the high-ohmic resistive material.

3. A device according to claim 1, wherein the length of the wave-guide portion corresponds approximately to a quarter wave length of the interference wave range, and with the stray capacitance between the cavity of the electron tube and the wave-guide portion forming a series resonance circuit.

4. A device according to claim 3, wherein cooling means is provided adjacent the high-ohmic resistive material.

5. A device according to claim 1, wherein the thickness of the dielectric window corresponds approximately to a half wave length of the interference wave range in the cavity of the electron tube.

6. A device according to claim 1, wherein the thickness of the dielectric window is approximately equal to a quarter wave length of the interference wave range in the cavity of the electron tube, and the characteristic impedance in the dielectric window is the geometric means of the characteristic impedances of the cavity of the electron tube and of the wave-guide portion.

7. A device according to claim 1, wherein the dielectric window comprises at least two thin-wallled window sections which are spaced from one another by approximately a quarter wave length of the interference wave range, and possess a low dielectric constant.

* * * * *